US007641078B2

(12) United States Patent
Boumnso

(10) Patent No.: US 7,641,078 B2
(45) Date of Patent: Jan. 5, 2010

(54) DEVICE FORMING PACKAGING FOR VISCOUS PRODUCTS, WHICH CAN BE FULLY EMPTIED BY MEANS OF MANUAL PUMPING

(76) Inventor: Jérôme Boumnso, 64, Rue Lasègue, 92320 Chatillon (FR)

( * ) Notice: Subject to any disclaimer, the term of this patent is extended or adjusted under 35 U.S.C. 154(b) by 743 days.

(21) Appl. No.: 10/529,179

(22) PCT Filed: Sep. 23, 2003

(86) PCT No.: PCT/FR03/02797

§ 371 (c)(1),
(2), (4) Date: Jan. 5, 2006

(87) PCT Pub. No.: WO2004/028924

PCT Pub. Date: Apr. 8, 2004

(65) Prior Publication Data

US 2006/0163287 A1 Jul. 27, 2006

(30) Foreign Application Priority Data

Sep. 24, 2002 (FR) ..... 02 11799

(51) Int. Cl.
*B65D 37/00* (2006.01)

(52) U.S. Cl. ..... 222/209; 222/95; 222/105; 222/206; 222/386.5

(58) Field of Classification Search ..... 222/94–95, 222/105, 386.5, 206, 213–215, 209, 389, 222/481.5, 183; 215/11.3, 11.5
See application file for complete search history.

(56) References Cited

U.S. PATENT DOCUMENTS

| | | | | | |
|---|---|---|---|---|---|
| 2,671,579 | A | * | 3/1954 | Knoblock | 222/105 |
| 2,777,612 | A | * | 1/1957 | Bensen | 222/209 |
| 3,306,500 | A | * | 2/1967 | Williams | 222/209 |
| 4,020,978 | A | * | 5/1977 | Szczepanski | 222/209 |
| 4,842,165 | A | * | 6/1989 | Van Coney | 222/95 |
| 5,012,956 | A | * | 5/1991 | Stoody | 222/94 |
| 5,303,852 | A | * | 4/1994 | Yamawaki et al. | 222/209 |
| 5,373,967 | A | | 12/1994 | Grooms et al. | |
| 5,429,702 | A | | 7/1995 | Grooms et al. | |
| 5,529,213 | A | | 6/1996 | Mack et al. | |

FOREIGN PATENT DOCUMENTS

| | | |
|---|---|---|
| EP | 0 505 611 | 9/1992 |
| WO | WO 93 14021 | 7/1993 |

* cited by examiner

*Primary Examiner*—Frederick C. Nicolas
(74) *Attorney, Agent, or Firm*—Young & Thompson

(57) ABSTRACT

A packaging which enables a compressible container to be fully emptied by pressing the fingers against the body thereof. The packaging has four parts, namely: a body having a vent hole, a container with a discharge hole, a flexible pouch and a cap. The aforementioned flexible pouch retracts and moves back completely until it is applied against the inner wall of the container. When the user exerts pressure on the body of the packaging while blocking the vent hole with a finger, all of the contents are discharged from the flexible pouch gradually and without effort, by compressing the air contained in the body. The device can be adapted to all compressible packaging for liquid, viscous or pasty products.

20 Claims, 8 Drawing Sheets

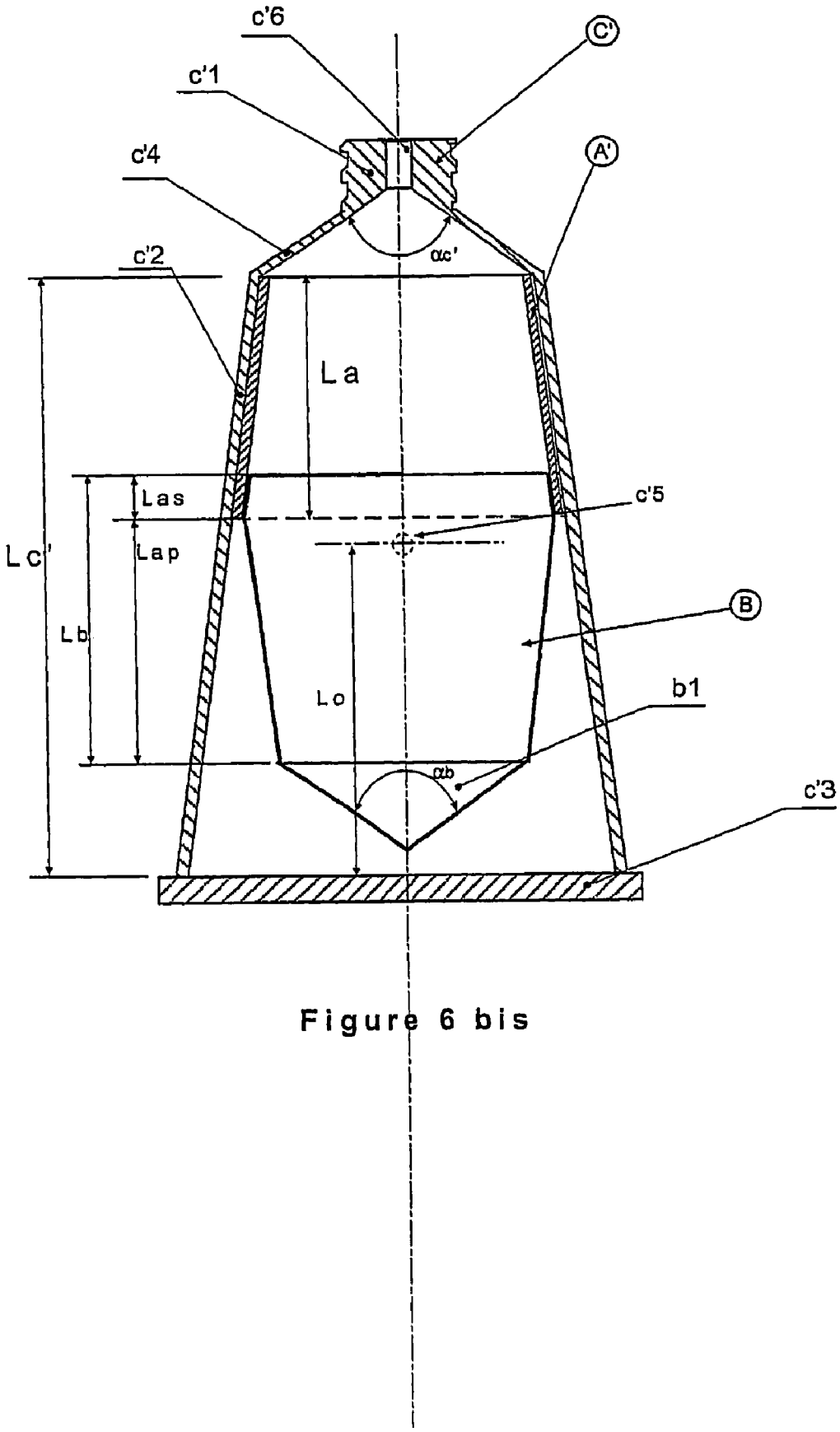
Figure 6 bis

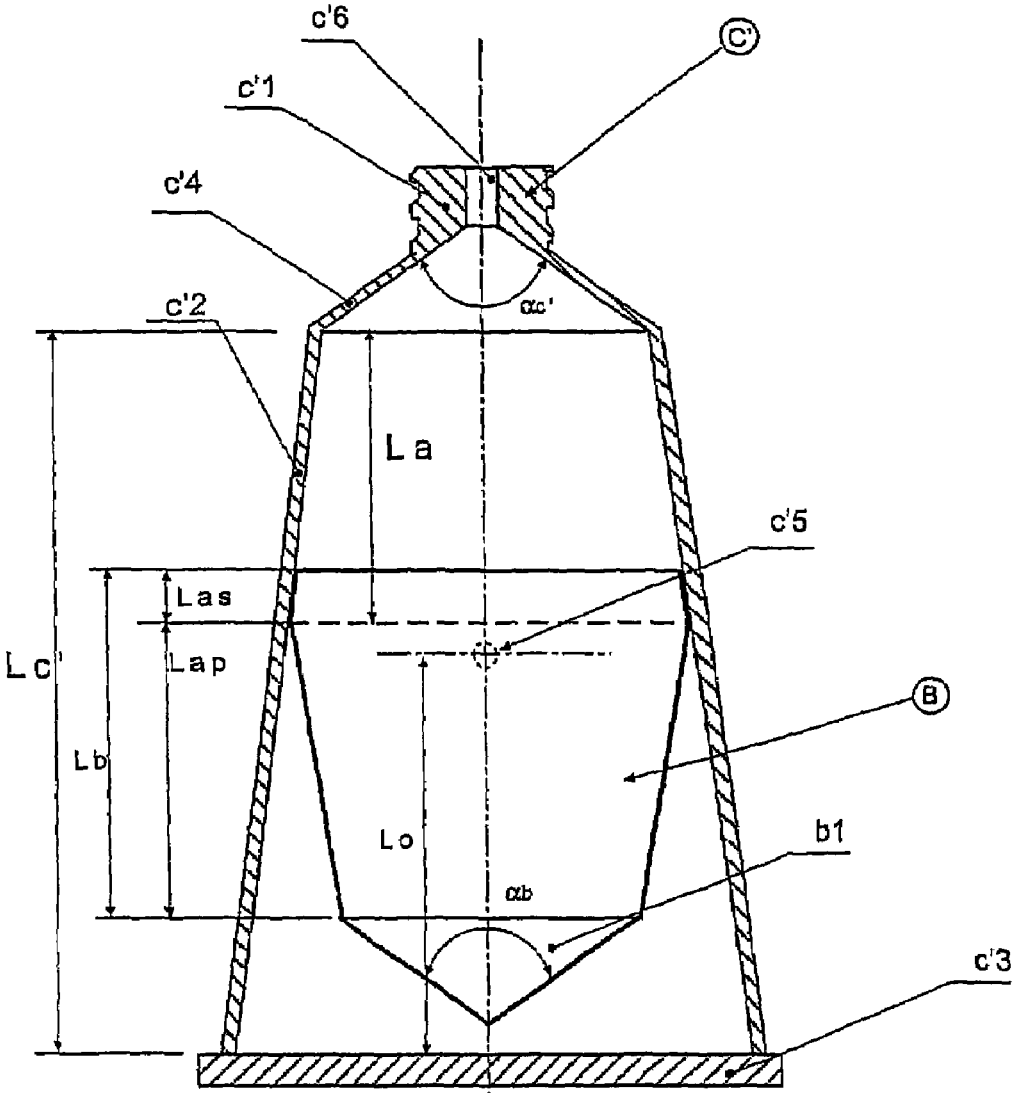
Figure 8 bis

DEVICE FORMING PACKAGING FOR VISCOUS PRODUCTS, WHICH CAN BE FULLY EMPTIED BY MEANS OF MANUAL PUMPING

The present invention relates generally to flexible packaging which is emptied by compression, such as tubes, and permits the complete emptying without deformation of the package, of liquid, viscous and pasty products such as cosmetic creams, gels, shampoos, paints, toothpaste, food products, repair paste, etc.

BACKGROUND OF THE INVENTION

Conventionally, the emptying of a compressible container is carried out by successive applications of pressure. The closer to emptying, the more force must be applied to the body of the package to deform it. When the package begins to be empty, it is necessary to turn it inside out to bring the remaining product toward the outlet. When the package is almost empty, it is necessary to shake it strongly, twist it or cut it off to extract the last drop of product. Ideally, for better expulsion of the product, it is necessary to rest the package upside down so the product will flow toward its outlet, before use.

In general, it is hardly possible to empty all the content of a container such as a conventional tube, which has the result of loss of about 10 to 15% of the product.

DESCRIPTION OF THE RELATED ART

There is particularly in the prior art, different types of techniques to optimize the total emptying of flexible packaging for viscous products.

Devices adapted for flexible tubes permit maintaining a product remaining in the package always in the upper portion of the tube near the outlet. The device as disclosed in FR2 775 957 does not permit recovering the product contained in the neck near the rigid head of the tube.

The prior art provides deformable flexible packaging integrally compressible so as to recover the maximum of the product by pressure. The device as disclosed in FR2 792 615 requires careful and energetic manipulation during recovery of the last drops of product. Thus, after rolling up the body of the package, it is necessary still to compress the head to extract the remaining product. The devices shown in FR2 796 622 permit recovering with the help of a utensil or a finger the last drops of product in the neck of the dispensing head. As in the preceding example, this device is neither practical nor easy to use.

The prior art provides devices for extracting the product from a package by a dispenser. The device as disclosed in FR2 800 718 is a package provided with a flexible pouch containing the product extracted by pumping, but has the drawback of delivering only small doses upon each pressing on the dispenser.

SUMMARY OF THE INVENTION

The package assembled according to the invention permits overcoming these drawbacks. It provides, in this context, a way of complete emptying by pumping by compression of the body, without real deformation of the package. The loss of product is of the order of 1 to 3%. Independently of the quantity of product in the package, the emptying takes place with the same comfort and the same facility as when it was full and this no matter what the position in which the package is disposed before use, and no matter what its position at the time of emptying. By way of non-limiting example, the package disclosed is a tube.

The device forming an assembled package comprises four parts A, B, C, D FIG. 4:

- piece (A) (FIG. 4) so-called container provided with an end comprising a truncated conical shoulder (a3) surmounted by a neck (a1) comprising a dispensing channel (a2), and on its other end (a5), an opening.
- piece (B) (FIG. 4) so-called retractable flexible pouch comprising a conical end (b1) and another open end (b2), and the pieces (A) and (B) being welded by their respective opened ends (a5) and (b2), the assembly of the pieces (A) and (B) thus forming a sealed package adapted to receive the product whose filling takes place through the dispensing channel (a2) of the container (A).
- piece (C) (FIG. 4) so-called body provided with a lateral vent opening (c5) closable manually so as to constitute, during pressure on the assembly, a "pumping system" of which one end (c3) is closed by crushing, and the other end comprises a truncated conical shoulder (c4) comprising an opening (c1), wherein before closing the end (c3), the assembly of pieces (A) and (B) is fitted into the body (C) into abutment against the connection of the truncated shoulder (c4) in a sealed manner.
- piece (D) (FIG. 4) so-called cap adapted to close the neck (a1) of the assembly of pieces A+B+C.

The device according to the invention can also be used and emptied exactly as a conventional package by successive pressing without the use of the vent opening (c5). At any time during emptying, one can choose or not to use the vent opening. The best result is obtained, particularly at the end of emptying, by the use of this vent opening. Thus, the package empties by pumping when the pressure of the fingers on the body takes place whilst the thumb obstructs the vent opening (c5) of the body (C). The air is compressed between the body (C) and the retractable flexible pouch (B) and turns this flexible pouch inside out into the interior of the body (A) and thus presses the product toward the distribution channel (a2), see FIG. 12. In its empty position, the flexible pouch (B) is retracted to the maximum against the walls of the container (A), see FIG. 13. There is thus no more product in the package and it nevertheless maintains its initial appearance as if it were full.

According to a first particular embodiment (FIGS. 6, 6*bis*, 7):

- piece (A') or container is open at the two ends, and at the end (a'5), the flexible retractable pouch (B) is welded by its end (b2),
- piece (C') or body is constituted by a tubular skirt (c'2) of which one end (c'3) is closed by crushing, and the other end comprises a truncated conical shoulder (c'4) with a neck provided with a screw thread, comprising a dispensing channel (c'6) closed by the cap (D), and in which before closure of the end (c'3), the assembly of pieces (A') and (B) is fitted into said body (C') in abutment against the connection of the truncated shoulder (c'4) in a sealed manner by cementing.

According to a second particular embodiment (FIGS. 8, 8*bis*, 9):

The open end (b2) of the flexible pouch (B) is directly welded over an assembly zone of several millimeters (Las) with the interior of the internal wall of the body (C'), wherein for example: La=Lap<Lc'/2 in which (La) represents the distance between the junction (c'4) (c'2) and the end of the assembly zone (Las), in which (Lap) represents the apparent retractable portion of the flexible pouch comprised between the end of the assembly zone (Las) and the beginning of the conical end (b1), in which (Lc') represents the distance between the junction (c'4) (c'2) and the bottom (c'3). The bent opening (c'5), located on the body (C'), can be positioned at a distance (Lo) from the bottom (c'3) at most equal to the length of thumb so that naturally the thumb will come to bear against this opening, wherein for example: Lo<Lc'/2. The assembly C' and B forms a sealed package adapted to receive the product whose filling takes place through the dispensing channel (c'6) of the body (C').

According to other embodiments:

The device can comprise, as a modification, on the body (C) (C') a vent opening provided with a valve. During pressure of the user on the package body to extract the product, the valve closes the opening and maintains the air in the body (C) (C') and this without the user having need to position his thumb against the opening. The valve could thus be positioned at anyplace on the surface (c2) (c'2) of the body (C) (C').

The neck (a1) FIG. 4 and (c'1) FIG. 6 can be by way of non-limiting example of conical or cylindrical shape, and comprise any system of securement of the cap (D) by screwing or snapping on.

The assembly of the container (A) with the body (C) (see FIG. 4) by the passage of the neck (a1) through the opening (c1) can take place by screwing instead of welding, by tapping (c1) and adapting the diameter (d1) of the body (C) to the diameter (d2) of the screw thread of the neck (a1) of the container (A). The gripping of the two pieces against each other has the effect of crushing the sealing joints (1) or the cement disposed between the two shoulders (a3) and (c4).

The assembly of the container (A) and of the body (C) (see FIG. 4), can as a modification be effected by any system of snapping in the neck (a1) of the container (A) through the opening (c1) of the body (C). Sealing is also obtained by the joints (1) or by cement at the two shoulders (a3) and (c4).

The assembly of the pieces (A) and (C) (see FIG. 4) can also be carried out by providing, after passage of the neck (a1) of the container (A) through the opening (c1) of the body (C), a nut or washer which will respectively be screwed or snap on the neck (a1) and thus grip the two pieces against each other. Sealing is also obtained by the joints (1) or by cement at the two shoulders (a3) and (c4).

The body (C) or (C') (see FIG. 10) can be constituted of at least two portions thus forming the body of the compressible package about the assembly of the reservoir (A) and the pouch (B), such as two shells or such as a bottle with a separate connected flat bottom or else a separate head (c'1) and shoulder (c'4) assembled on (c'2) (see FIG. 6 bis).

The cap (D) (FIG. 4) if it is provided with a pouring opening for flow of the product, can by snapping or screwing on the neck (a1) fit the pieces (A) and (C) against each other. The joints (1) crushed by gripping at the shoulders, guarantee the sealing of the assembly at this point. Thus, the cap (D) thus positioned will hold the pieces (A) and (C) assembled, and without the need to unscrew, permits during emptying the flow through the pouring opening of the product contained in the assembly of container (A) and pouch (B).

The container (A) can as a modification have a cylindrical, circular, conical, cubic shape or a combination of these shapes. The flexible pouch (B) is thus adapted as to its size to the shape of the container (A), such that during its inversion at the time of emptying, the pouch (B) will always be firmly pressed against all the internal walls of the container (A).

For ease of production, there can be carried out welding by pinching the conical base of the flexible pouch (B) (b1) in the same plane with an angle ($\alpha$b) equal to the angle ($\alpha$a) of the truncated conical shoulder of the internal tube (a3) and thus, in this embodiment, there will remain a small quantity of product in the tube which nevertheless is quite a bit less than what remains in a conventional tube after total emptying.

BRIEF DESCRIPTION OF THE DRAWINGS

The accompanying drawings show the invention and different embodiments:

FIG. 6 bis shows a front cross-sectional view of the device (pieces A', B, C') in a first particular embodiment of the invention.

FIG. 8 bis shows a front cross-sectional view of the device (pieces B, C') in a second particular embodiment of the invention.

DETAILED DESCRIPTION OF THE PREFERRED EMBODIMENTS

Figure 4:
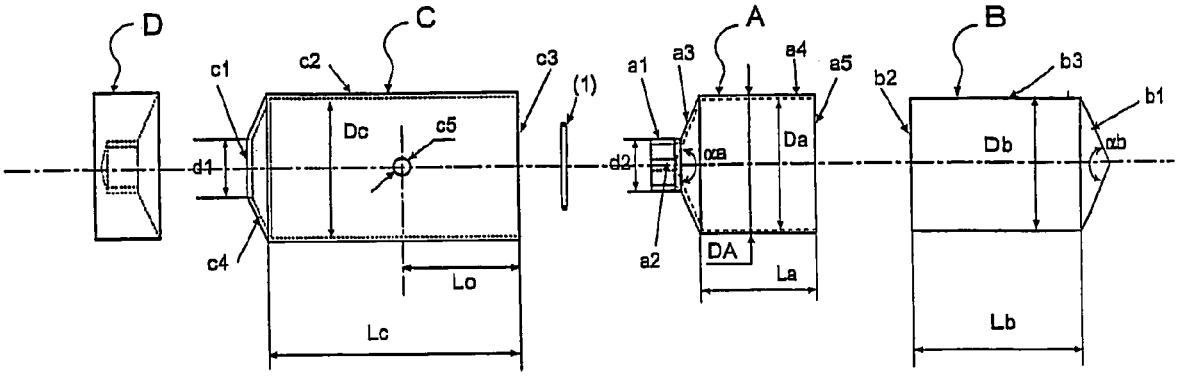
FIG. 4 shows an exploded view of the device (pieces A, B, C, D).

In reference to the drawings, the device is an assembly of four pieces (A, B, C, D);

For the particular case of a tubular package, it comprises a container (A) FIG. 4 whose characteristics are the same as a conventional tube in its upper portion. It is comprised at one end by a neck (a1), provided with a dispensing channel (a2) connected by a truncated conical shoulder (a3) to a tubular skirt (a4) which can be of thermoplastic material and obtained by extrusion, and at the other end (a5) provided with an opening. By way of non-limiting example, the tubular skirt (a4) can have a length (La), defined by the end (a5) and the junction between the truncated conical shoulder (a3) and the tubular skirt (a4), less than (Lc)/2, in which (Lc) is the distance defined by the junction (c4) and (c2) and the base (c3) of the body (C).

Figures 1, 2, 3:
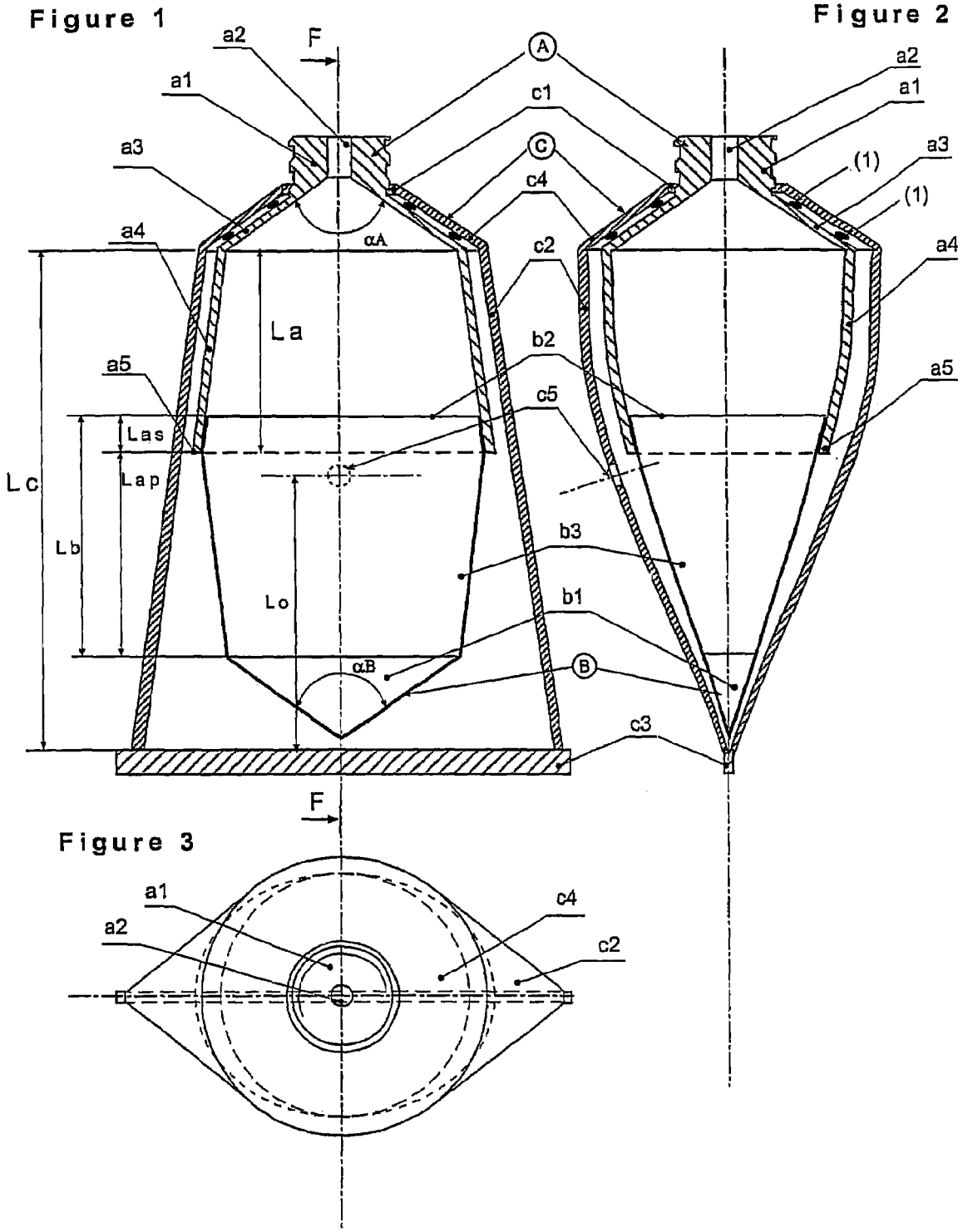
FIG. 1 shows the device of the invention in front cross-section.
FIG. 2 shows the device of the invention in profile view on the line F-F.
FIG. 3 shows the device seen from above.
Figure 13:
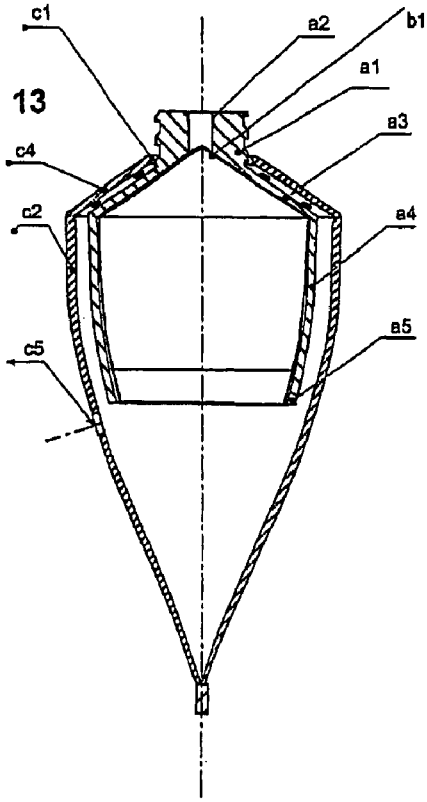
FIG. 13 shows the device of the invention, in cross-section, in profile, in its empty position with the flexible pocket inverted all the way into the tube.

The device comprises a flexible cylindrical pouch of polyethylene, piece (B), whose open end (b2) is fixed preferably by thermowelding on the opening (a5) of the container (A). In FIG. 1, the assembly zone (Las), defined by the connecting portion between the container (A) and the pouch (B), is located in a preferred embodiment within the wall of the container A. FIG. 13 shows how, during complete emptying of the package, the pouch (B) is completely retracted by inversion and pressed against the internal walls of the container (A). As seen in FIG. 1, this phenomenon is optimized when the length (Lap) of the pouch (B), defined by the end (a5) and the junction (b1) and (b3), is equal to the length (La) of the container (A), with the diameters (Db) of the pouch (B) and (Da) of the container (A) equal as seen in FIG. 2. By way of non-limiting example, the flexible pouch (B) will have a thickness of the order of several microns and a length (Lb) (FIG. 1) such that (Lb=Lap+Las) in which the assembly zone (Las) can comprise by way of non-limiting example 10% of Lb. The base of the flexible pouch (b1) is preferably conical with the same angle (αb) as that of the truncated shoulder within the container (A) (αa), which permits providing, at the end of pumping, a good pressing of the flexible pouch against the shoulder of the container (A) and to expel the maximum of the product toward the dispensing channel (a2). The assembly of container (A) and flexible pouch (B) forms a sealed package adapted to receive the product whose filling takes place through the dispensing channel (a2).

Figure 5:
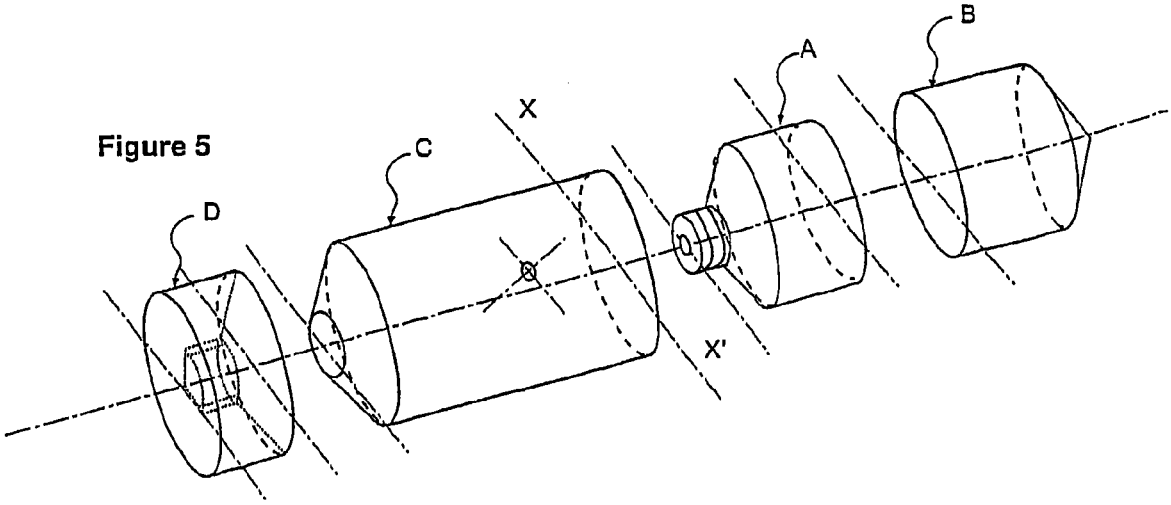
FIG. 5 shows an exploded view of the device in 3 dimensions.
Figure 6:
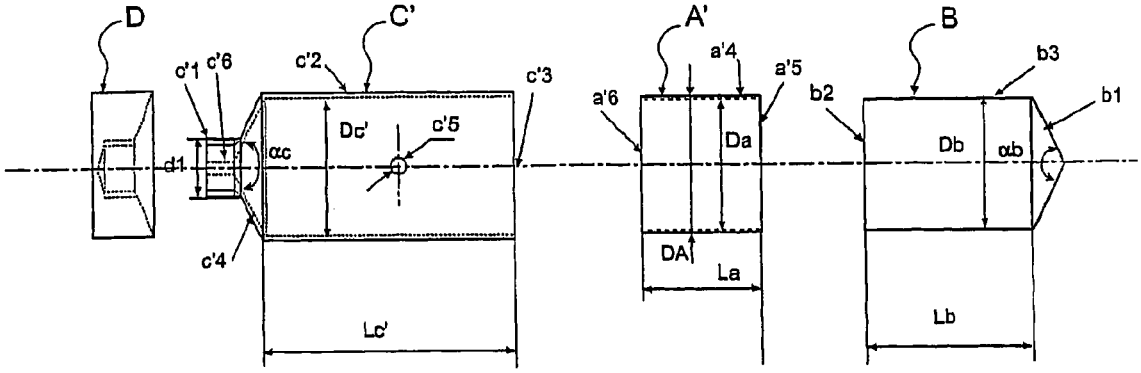
FIG. 6 shows an exploded view of the device (pieces A', B, C') in a first particular embodiment of the invention.
Figure 7:
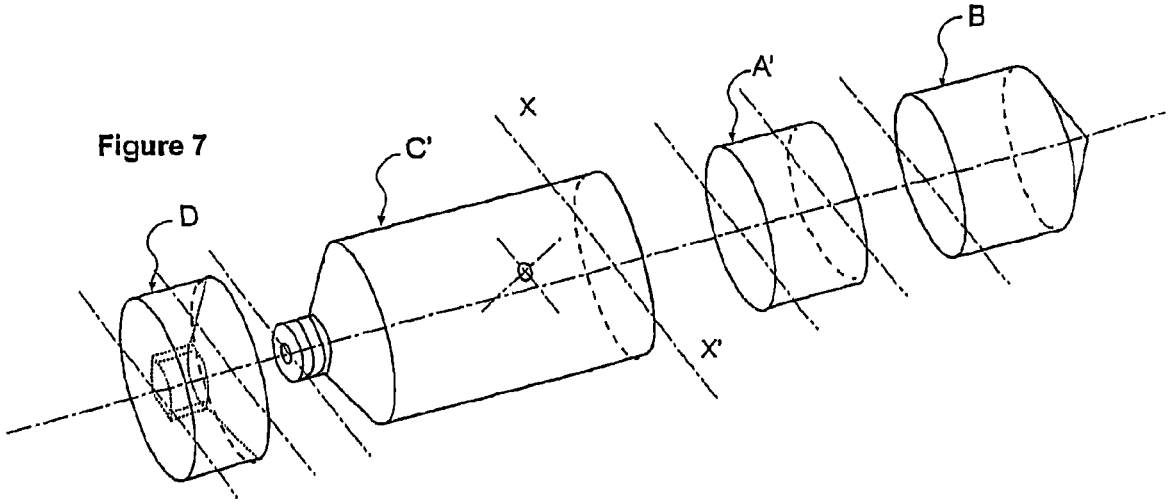
FIG. 7 shows an exploded view of the device in 3 dimensions, in a first particular embodiment of the invention.
Figure 8:
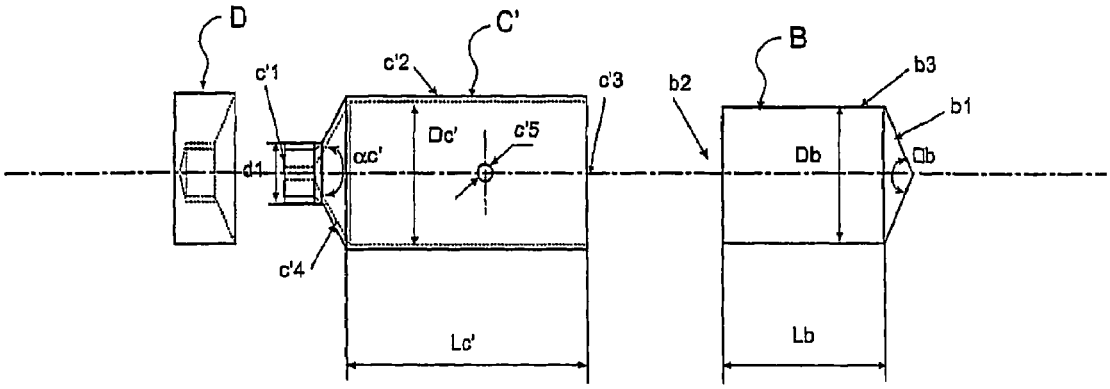
FIG. 8 shows an exploded view of the device (pieces B, C', D) in a second particular embodiment of the invention.
Figure 9:
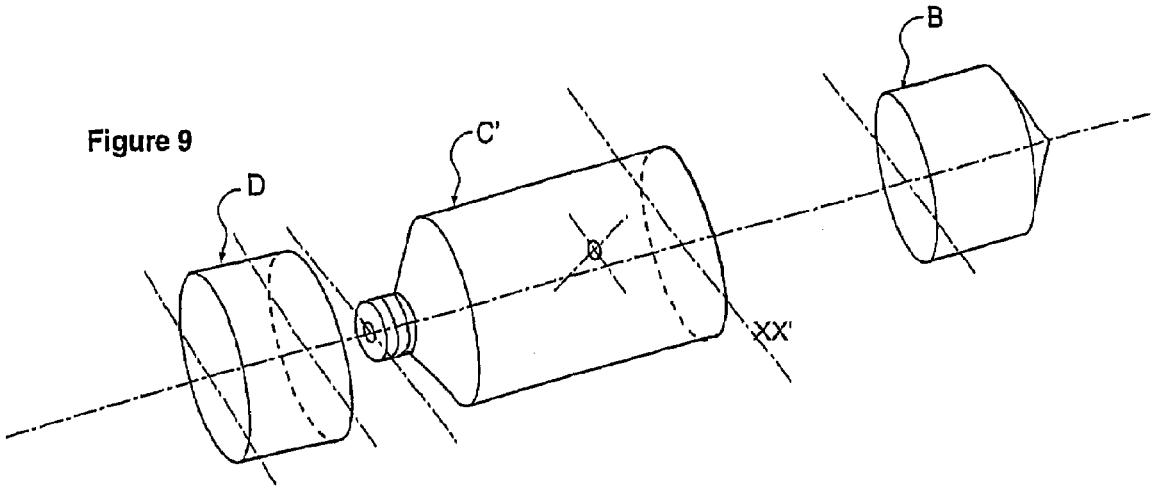
FIG. 9 shows an exploded view of the device in 3 dimensions, in a second particular embodiment of the invention.

The device comprises a body (C) (see FIG. 4) which is in fact a conventional tube which, instead of having a neck at the top, has an opening. This tube comprises a truncated conical shoulder (c4), provided with an opening (c1), connecting to the skirt as in a conventional tube. During assembly of the container (A) and the pouch (B), in the body (C), the head (a1) of the container (A) passes through the opening (c1) of the body (C) until the neck of the container (a3) comes into abutment against the neck (c4) of the body (C). The diameter (d1) of the opening (c1) of the body (C) is such as to let pass the neck (a1) of a diameter (d2) of the container (A). For optimum operation (see FIG. 2 and FIG. 4), the sealing of the assembly can be, in a preferred embodiment, guaranteed by cylindrical joints (1) or by sealed cementing of the body (C) and the container (A) at the necks (c4) and (a3). The securement and holding of the assembly A and B in the body (C) can be, by way of non-limiting example, carried out either by welding or by snapping in of the head (a1) with the opening (c1), or by gripping the pouring cap on the head (a1), or by gripping a plastic knob of small thickness on the head (a1), or by snapping a washer on the head (a1), or by screwing (a1) through the opening (c1) thus provided, a screw. The body (C) (see FIGS. 4 and 5) comprises an elongated tubular skirt (c2), obtained by extrusion, whose other end (c3) is closed, in the case of a tube, after assembly, by crushing along an axis XX' perpendicular to the axis of the tube. For good fitting during assembly, the internal diameter (Dc) of the body (C) is selected and the maximum external dimensions (DA) of the container (A). So that the system will operate well, the body (C) comprises on its skirt (c2) a lateral front opening (c5) located, by way of non-limiting example, by the distance (LO) less than LC/2 from the end (c3). The diameter, by way of non-limiting example, of the opening (c5) can be from 1 to 6 millimeters in diameter. The opening (c5) (c'5) is preferably and for comfort of the user positioned in an ergonomic region of the hand so that the thumb will naturally cover the opening during emptying of the package. The placing of the opening (c5) (c'5) can be marked by an adhesive dot such that it can be rapidly located visually and by touch. The opening (c5) (c'5) can be provided with a valve, and thus can be, in this particular case, located anywhere on the body (C), which frees the user from the operation of pressing on this opening (c5) to extract the product.

Figure 10:
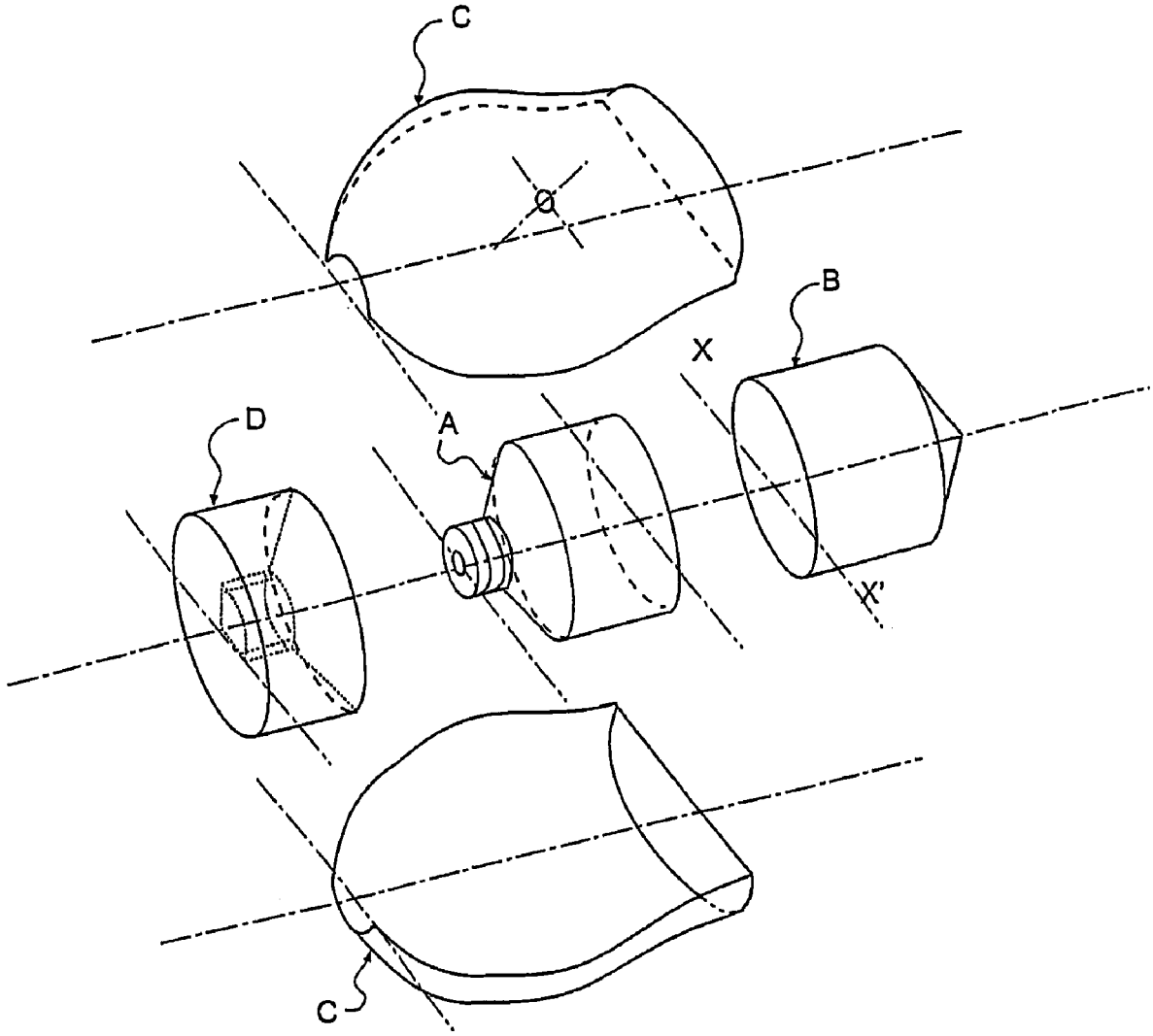
FIG. 10 shows an exploded view of the device in 3 dimensions, in a particular embodiment of the invention.
Figure 11:
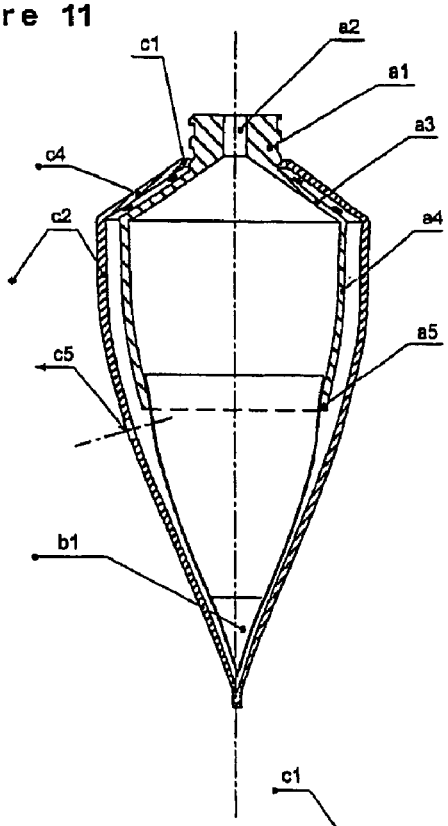
FIG. 11 shows the device of the invention, in cross-section, in side view, in its "full of product" position.
Figure 12:
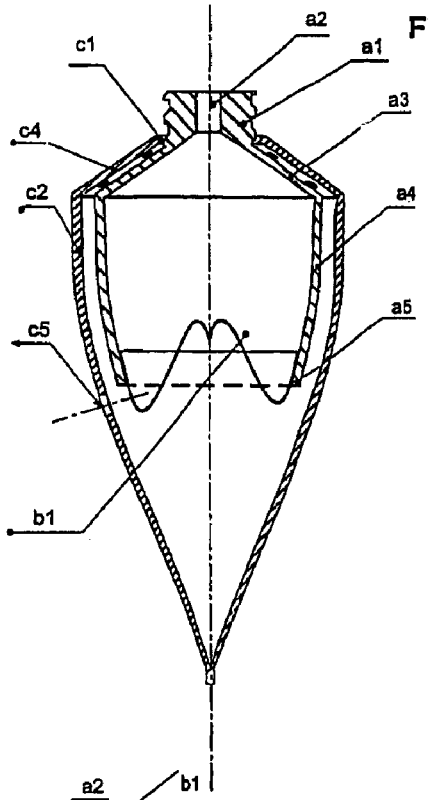
FIG. 12 shows the device of the invention in cross-section, in side view, in its intermediate emptying position.

In the preferred embodiment, the four elements of the invention are assembled in the following order: assembly by welding of the flexible pouch B and the container A, then insertion and securement of the assembly A and B in the body (C). Finally, the body (C) is closed at its larger opening end (c3) by crushing. The cap (D) is fixed on the neck (a1) extending beyond the body. The cylindrical and tubular shape of the body (C) is not limiting, this latter can have any geometric shapes of the type of a bottle closed by a flat bottom at the end (c3), shell in two pieces as in FIG. 10. Similarly for the pieces B, C, D, the system can easily be adapted to different geometric shapes whilst respecting the complementary character of the pieces A, B, C, D.

For use of the package, the opening (c5) is closed with the thumb, and the body (C) is compressed, then the thumb is removed so that air can once more enter the peripheral space located between the pouch (B) and the body (C) and so on to ensure the progressive penetration by inversion of the pouch (B) within the container (A), thus, the invention has for its object a device for completely emptying a compressible package for liquid, viscous and pasty products. The invention relates to a package permitting the complete emptying of compressible receptacles by pressure of the fingers on their bodies. It is constituted by four parts: a body (C) having a vent opening, a container (A) having an extension opening, a flexible pouch (B) and a cap (D).

The flexible pouch retracts and turns inside out completely, until it is pressed against the internal wall of the container. When the user exerts pressure several times on the body (C) of the package by closing with a finger the vent opening (c5), all the product contained in the flexible package is expelled, progressively and without great force, by compression of the air contained in the body.

The device according to the invention is adapted to any compressible package for liquids, viscous or pasty products.

The invention claimed is:

1. A device providing a package for viscous products configured to be completely emptied by manual pumping, comprising:

a reservoir (A) provided with a first end comprising a truncated conical shoulder (a3) surmounted by a neck (al) comprising a dispensing channel (a2), and a second end (a5) comprising an opening;

a flexible retractable pouch (B) comprising a conical end (b1) and an open end (b2), the open end (b2) of the retractably pouch (B) connected to the second end (a5) of the reservoir (A) to form a sealed package configured to receive a product through the dispensing channel (a2) of the reservoir (A);

a body (C), provided with a third end (c3), a fourth end, and a lateral vent opening (c5) closable manually so as to constitute, upon an application of pressure on the sealed package, a pumping system, the third end (c3) configured to be closed by crushing, and the fourth end comprising a truncated conical shoulder (c4) comprising a body opening (c1); and a cap (D) adapted to close the neck (al) of the reservoir (A), wherein the reservoir (A) and the retractable pouch (B) are fitted in the body (C) in abutment against a connection of the truncated conical shoulder (c4) in a sealed manner.

2. The device according to claim 1, wherein the vent opening (c5) of the body (C) comprises signaling means and is positioned at a distance (LO) from the third end (c3) configured such that a user's thumb can cover and close the vent opening (c5).

3. The device according to claim 1, wherein the opening vent (c5) of the body (C) is provided with a valve.

4. The device according to claim 1, wherein the neck (a1) is one of conical and cylindrical, and further comprises a system for securing the cap by one of screwing and snapping.

5. The device according to claim 1, wherein an assembly of reservoir (A) with the body (C) is provided by a screw thread on the neck (al) interfacing with the body opening (c1).

6. The device according to claim 1, wherein the reservoir (A) is configured to be assembled with the body (C) such that the neck (al) of the container (A) is fitted through the body opening (c1) of the body (C) and secured to the body (C) by snapping.

7. The device according to claim 1, wherein the reservoir (A) is configured to be assembled with the body (C) such that the neck (a1) of the container (A) is fitted through the body opening (c1) of the body (C), and secured by way of a nut or a washer screwed on or snapped on the neck (al) to grip the reservoir (A) and the body (C) together.

8. The device according to claim 1, wherein the body (C) is constituted of at least two parts.

9. The device according to claim 1 wherein the cap (D) is provided with a pouring opening for flow of the product, and is configured to be fixed by snapping or screwing onto the neck (al) so as to fit the reservoir (A) and the body (C) against each other.

10. The device according to claim 1, wherein the flexible pouch (B) is configured to be closed by pinching the conical end (b1) in a same plane with an angle ($\alpha$b) equal to an angle ($\alpha$a) of the truncated conical shoulder (a3).

11. The device according to claim 1, wherein the container (A) is of cylindrical, circular, conical, cubic shape or a combination of these shapes, and wherein the flexible pouch (B) is adapted in size to the shape of the container (A).

12. A device forming a package for pasty products with complete emptying by manual pumping, comprising:

a reservoir (A') provided with a first open end (a'6), and a second open end (a'5);

a flexible retractable pouch (B) comprising a conical end (b1) and an open end (b2), the open end (b2) of the retractably pouch (B) connected to the second open end (a'5) of the reservoir (A') by welding;

a body (C'), provided with a first end (c'3), a second end (c'1), and a lateral vent opening (c'5) closable manually so as to constitute, upon an application of pressure on the sealed package, a pumping system, the first end (c'3) configured to be closed by crushing, and the second end comprising a truncated conical shoulder (c'4) comprising a body opening (c1); and a cap (D), wherein the body (C') further comprises a tubular skirt (c'2), and the truncated conical shoulder (c'4) further comprises a neck (c'1) provided with a screw thread and a dispensing channel (c'6) configured to be closed by the cap (D), and wherein the reservoir (A') and the retractable pouch (B) are configured to be fitted in the body (C') in abutment against the connection of the truncated conical shoulder (c'4) in a sealed manner by cementing.

13. The device according to claim 12, wherein, the open end (b2) of the flexible retractable pouch (B) is directly welded over several millimeters (Las) to an interior of an internal wall of the body (C'), the vent opening (c'5) is located on the body (C'), and the cap (D) is configured to close the neck (c'1).

14. The device according to claim 12, wherein the vent opening (c'5) comprises signaling means and is positioned at a distance (LO) from the first end (c'3) such that user's thumb can cover and close the vent opening (c'5).

15. The device according to claim 12, wherein the vent opening (c'5) is provided with a valve.

16. The device according to claim 12, wherein the neck (al) is one of conical and cylindrical shape, and further comprises a system for securing the cap by one of screwing and snapping.

17. The device according to claim 12, wherein the body (C') is constituted of at least two parts.

18. The device according to claim 12, wherein the flexible pouch (B) is configured to be closed by pinching the conical end (bi) of said flexible pouch (B) in a same plane with an angle ($\alpha$b) equal to an angle ($\alpha$a) of the truncated conical shoulder (a3).

19. The device according to claim 12, wherein the container (A) is of cylindrical, circular, conical, cubic shape or a combination of these shapes, and wherein the flexible pouch (B) is adapted in size to the shape of the container (A).

20. The device according to claim 13, wherein the vent opening (c'5) of the body (C') comprises signaling means and is positioned at a distance (LO) from the first end (c'3) configured such that a user's thumb can cover and close the vent opening (c'5).

* * * * *

UNITED STATES PATENT AND TRADEMARK OFFICE

CERTIFICATE OF CORRECTION

PATENT NO. : 7,641,078 B2
APPLICATION NO. : 10/529179
DATED : January 5, 2010
INVENTOR(S) : Jérôme Boumnso It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1037 days.

Signed and Sealed this

Twenty-first Day of December, 2010

David J. Kappos

David J. Kappos
*Director of the United States Patent and Trademark Office*